United States Patent [19]

Nonnemacher et al.

[11] 4,158,529

[45] Jun. 19, 1979

[54] CONTROL DEVICE FOR A PUMPING ARRANGEMENT

[75] Inventors: Gerhard Nonnemacher, Korntal; Emil Knodel, Stuttgart; Paul Bosch, Ludwigsburg, all of Fed. Rep. of Germany

[73] Assignee: Robert Bosch GmbH, Stuttgart, Fed. Rep. of Germany

[21] Appl. No.: 657,082

[22] Filed: Feb. 11, 1976

[30] Foreign Application Priority Data

Feb. 12, 1975 [DE] Fed. Rep. of Germany ..... 2505780

[51] Int. Cl.[2] ..... F04B 49/00

[52] U.S. Cl. ..... 417/216; 60/447; 417/218

[58] Field of Search ..... 417/216, 218, 221, 222; 60/445, 448, 449, 452, 488, 447

[56] References Cited

U.S. PATENT DOCUMENTS

| | | | |
|---|---|---|---|
| Re. 29,333 | 8/1977 | Pensa | 417/222 X |
| 3,302,585 | 2/1967 | Adams et al. | 417/222 X |
| 3,635,021 | 1/1972 | McMillen et al. | 417/222 X |
| 3,669,570 | 6/1972 | Himmler | 417/222 |
| 3,672,166 | 6/1972 | Isaac | 60/447 |
| 3,796,517 | 3/1974 | Praddaude | 417/216 |
| 3,891,354 | 6/1975 | Bosch | 60/449 |
| 3,932,993 | 1/1976 | Riedhammer | 60/431 |
| 3,935,707 | 2/1976 | Murphy et al. | 60/444 |
| 3,985,472 | 10/1976 | Virtue et al. | 417/216 |
| 4,047,590 | 9/1977 | Hoashi et al. | 60/447 X |

FOREIGN PATENT DOCUMENTS

| | | | |
|---|---|---|---|
| 1528476 | 8/1969 | Fed. Rep. of Germany | 417/426 |
| 2363480 | 6/1975 | Fed. Rep. of Germany | 417/221 |

*Primary Examiner*—Carlton R. Croyle
*Assistant Examiner*—Edward Look
*Attorney, Agent, or Firm*—Michael J. Striker

[57] ABSTRACT

An arrangement for pumping fluids includes at least one variable-output pump and a drive therefor. An auxiliary pump is also driven by the drive and discharges control fluid at a discharge rate which corresponds to the speed of rotation of the drive. A throttle valve is located in a discharge conduit of the auxiliary pump, and the pressure of the control fluid upstream of the throttle valve controls the displacement of a slide valve between two positions thereof in one of which the control slide controls the variable-output pump toward increasing the output thereof, while in the other of such positions the pump is controlled toward a reduced output thereof. In addition to the pressurized fluid, which acts on the control slide with a first force, a spring is provided which acts on the control slide with a second force opposing the first force. One of these forces is varied in response to variations in the output rate of the variable-output pump so that the ratio of the first force to the second force increases with the diminishing output rate of the variable-output pump. Advantageously, the position of an adjusting element of the variable-output pump is used as an indication of the output rate of the pump. The signal derived from the position of the adjusting element is used either for tensioning or relaxing the spring, or for increasing or decreasing the flow-through cross-sectional area of the throttle valve.

24 Claims, 5 Drawing Figures

CONTROL DEVICE FOR A PUMPING ARRANGEMENT

BACKGROUND OF THE INVENTION

The present invention relates to a pumping arrangement in general, and more particularly to a control arrangement which is to be used in connection with an arrangement for pumping fluids and operative for controlling the output rate thereof.

There are already known various pumping arrangements of the type here under consideration. Usually, such arrangements include one or more pumps which is or are driven by a drive, such as an internal combustion engine. In such pumping arrangements, it is also known to provide an auxiliary pump which discharges control fluid at a rate corresponding to the speed of the drive, a flow restrictor or a throttle being provided in the discharge conduit of the auxiliary pump. It is known from these conventional arrangements that, when the flow restrictor or throttle is of a fixed flow-through cross-sectional area, the pressure in the discharge conduit upstream of the throttle will vary proportionately to the square of the speed of rotation of the auxiliary pump which, in turn, depends on the speed of rotation of the drive. Thus, the pressure in the discharge conduit upstream of the throttle will give an indication of the speed of rotation of the drive. It is also already known from the prior art to utilize the pressurized fluid in the discharge conduit of the auxiliary pump for displacing a control slide or a similar valve between two positions of the same, the control slide being interposed into the control circuit of the respective pump so as to control the fluid flow therethrough in such a manner that, when the pressure in the discharge conduit of the auxiliary pump rises above a predetermined level, the variable-output pump is adjusted toward higher output rates, and conversely when the pressure in the discharge conduit drops below a predetermined value.

In such conventional control arrangements for controlling the output of a variable-output pump, the flow-through cross-sectional area of the throttle, which is determinative of the pressure with which the control fluid in the discharge conduit of the auxiliary pump acts on the control slide, and the force exerted on the control slide by a spring which urges the control slide against the action of the pressurized control fluid, are so selected relative to one another that, when the speed of rotation of the drive decreases by a certain amount with respect to a predetermined operating value, the force of the spring overcomes the force exerted by the pressurized fluid in the discharge conduit on the control slide, and the latter is displaced into a position in which the output of the variable-output pump is decreased. One of the main disadvantages of these prior-art constructions is the fact that, in general, the adjustment of the output rate of the variable-output pump proceeds rather rapidly when compared to the rate at which the speed of rotation of the drive changes, so that there exists a danger that the control arrangement for the pumping arrangement may have a high degree of instability due to the likelihood that the control arrangement will so control the output rate of the pumping arrangement that the latter will overshoot or undershoot the proper values of the output rates which correspond to the proper loading of the drive.

SUMMARY OF THE INVENTION

Accordingly, it is a general object of the present invention to avoid the disadvantages of the prior-art pumping arrangements.

More particularly, it is an object of the present invention to provide a control arrangement for a pumping arrangement which is not possessed of the above-mentioned drawback.

It is a further object of the present invention to provide a control arrangement of the type here under consideration which is simple in construction and reliable in operation.

It is still another object of the present invention to provide a control arrangement which eliminates or at least reduces the tendency to overshoot.

A yet another object of the present invention is to provide a control arrangement which has a substantially improved stability when compared to the prior art control arrangements.

A concomitant object of the present invention is to provide a method of controlling a pumping arrangement which results in a variation in the output rate of the pumping arrangement within much narrower deviation range than heretofore known.

In pursuance of these objects and others which will become apparent hereafter, one embodiment of the present invention resides, briefly stated, in an arrangement for pumping fluids, in a combination which comprises pump means for pumping a fluid at a variable output rate; drive means for driving the pump means at different speeds; first generating means for generating a first signal proportionate to the instantaneous speed of the drive means; second generating means for generating a second signal indicative of the instantaneous output rate of the pump means; and adjusting means for adjusting the output rate of the pump means in dependence upon the first and second signals. The adjusting means, according to a further concept of the present invention, includes control means which is displaceable between two positions in which the pump means is adjusted toward higher and lower output rates, respectively, displacing means for displacing the control means between the positions thereof and including first biasing means which urges the control means toward one of the positions with a first force proportionate to the first signal, and second biasing means which urges the control means toward the other position with a second force, the adjusting means further including varying means for varying one of the forces in dependence on the second signal.

According to one currently preferred embodiment of the present invention, the second biasing means includes a spring, and the varying means so varies the second force that the spring is relaxed in response to the decrease in the output rate of the variable-output pump. In another preferred embodiment, the first generating means includes an auxiliary pump which discharges control fluid into a discharge conduit in which there is interposed a throttle valve, and the pressure in the discharge conduit upstream of the throttle valve acts on the control means. In this embodiment, the throttle valve has an adjustable flow-through cross-sectional area, and the varying means so varies the flow-through cross-sectional area that the latter decreases in response to a decrease in the output rate of the variable-output pump, thus increasing the resistance of the throttle valve to the flow of the control fluid through the discharge conduit and increasing the pressure of the control fluid upstream of the throttle valve which, in turn, results in an increase of the first force.

In this manner, the limiting-load rated speed of the drive is somewhat reduced concurrently with a continuing adjustment of the pump toward lower output rates thereof. Thus, the control arrangement obtains a region of proportionality. When the various components of the control arrangement are properly dimensioned, the entire control arrangement can be effectively stabilized. The existence of the region of proportionality results in a situation where a predetermined reduction of the output rate of the pump is associated with a certain reduction in the speed of rotation of the drive. According to a further currently preferred concept of the present invention, the pump means includes at least one variable-output pump which has an adjusting element movable between a high-output position and a low-output position through a plurality of intermediate positions. The actuating means further includes moving means which moves the actuating element between the above-mentioned positions thereof. In this embodiment, the control member controls the moving means. Preferably, the moving means includes a cylinder-and-piston arrangement which acts on the adjusting element, and conduit means supplies pressurized fluid to the cylinder-and-piston arrangement. The control means may include a control slide which is interposed in the conduit means and controls the supply of the pressurized fluid to the moving means.

It is also proposed according to the present invention that the control means include a valve housing which bounds a chamber with the control slide. The pressurized fluid from the discharge conduit of the auxiliary pump is then supplied into the chamber and acts on an end face of the control slide so as to displace the same against the force of the above-mentioned spring. The above-discussed control arrangement is especially suited for controlling a plurality of variable-output pumps which are driven in synchronism with one another by a drive and which have adjusting elements for adjusting the output rate of each of such pumps, the adjusting elements of the pumps being connected with one another. However, it will be appreciated that a similar concept may also be used for controlling a single variable-output pump. On the other hand, it is also possible to associate similarly constructed control means having the above-discussed proportionality characteristic with two or more of variable-output pumps, each of the control means being used for controlling one of such pumps. In this manner, all of such pumps can be adjusted to almost the same extent contemporaneously, without any mechanical connection between the adjusting elements of such pumps. This, in turn, results in a situation where it is possible to provide additional control valve means at the discharge side of the various pumps, so that one or more of such pumps can be disconnected from a user circuit into which the pumps discharge the fluid while the remaining pumps may continue their operation.

A further concept of the present invention resides in a method of controlling an arrangement for pumping fluids which includes at least one pump which discharges a fluid at a variable output rate, a drive for driving the pump at different speeds, and a control slide which is displaceable between two positions in which the pump is adjusted toward higher and lower output rates, respectively, the method of the invention comprising the steps of generating a first signal proportionate to the instantaneous speed of the drive; generating a second signal indicative of the instantaneous output rate of the pump; and adjusting the output rate of the pump in dependence on the first and second signals, including biasing the control slide toward one of said positions with a first force proportionate to said first signal, biasing the control slide toward the other position with a second force, and varying one of said forces in dependence on said second signal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
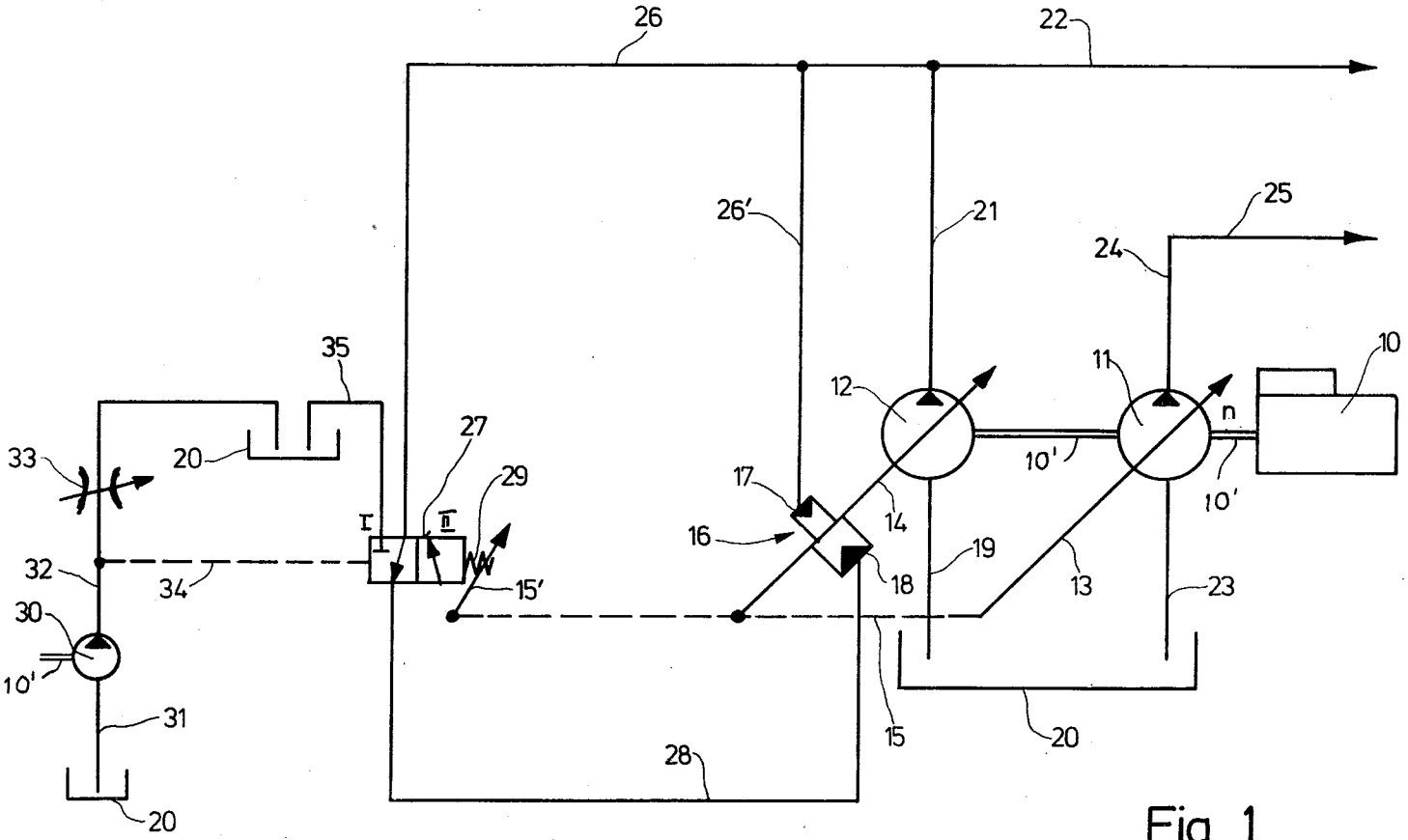
FIG. 1 is a graphic representation of a first embodiment of a control arrangement for a pair of variable-output pumps.

Referring now to the drawings in detail, and first to FIG. 1 thereof, it may be seen that the reference numeral 10 designates a drive, such as an internal combustion engine. The drive 10 has an output shaft 10' which simultaneously drives a pair of variable-output pumps 11 and 12 at the same speed. The respective variable-output pumps 11 and 12 are equipped with adjusting elements 13 and 14, respectively, which control the output rate of the variable-output pumps 11 and 12. A link 15 couples the adjusting elements 13 and 14 with one another.

The position of the adjusting element 14 is varied by means of a moving arrangement 16, which is constructed as a power amplifier or a servomotor. The power amplifier 16 acts on the adjusting element 14 of the pump 12 and includes a piston 17 of a smaller active area, and a piston 18 of a larger active area. Thus, the power amplifier is capable of operating according to a differential piston principle. The pump 12 draws fluid from a receptacle 20 via a conduit 19, and pumps the fluid, through a connecting conduit 21, into a first user circuit 22. Similarly, the pump 11 draws fluid from the receptacle 20 via a conduit 23, and pumps the fluid, through a connecting conduit 24, into a second user circuit 25.

A conduit 26 communicates with the conduits 21 and 22, and leads toward a control slide 27 which is capable of assuming two positions indicated in FIG. 1 as I and II. A conduit 26' branches off from the conduit 26 and leads toward the piston 17 of the power amplifier 16. A conduit 28 communicates the piston 18 of the power amplifier 16 with a side of the control slide 27 which is opposite to the conduit 26. A spring 29 acts on the control slide 27. The link 15 is connected to an extension 15' which cooperates with the spring 29 so as to vary the tension thereof.

The output shaft 10' of the drive 10 also drives an auxiliary pump 30 at a speed of n revolutions per minute, so that the auxiliary pump 30 draws control fluid from the receptacle 20 through a conduit 31 and discharges the control fluid in a conduit 32 which communicates with the receptacle 20, a throttle valve 33 being interposed in the conduit 32. The throttle valve 33 may either be of a fixed flow-through cross-sectional area, or may have an adjustable flow-through cross-sectional area. A control conduit 34 communicates with the conduit 32 upstream of the throttle valve 33, and supplies the control fluid therefrom to the control slide 27 so that the pressure of the control fluid acts on the control slide oppositely to the action of the spring 29 thereon. A relief conduit 35 leads from the control slide 27 to the receptacle 20.

The drive 10, such as an internal combustion engine, drives the pumps 11 and 12 and the auxiliary pump 30 at synchronous speeds. As the control fluid in the discharge conduit 32 passes through the throttle valve 33, the throttle valve 33 offers resistance to the flow of the control fluid therethrough, which results in an increase of the pressure head of the control fluid in the discharge conduit 32 upstream of the throttle valve 33. The increase in the pressure in the discharge conduit 32 is quadratically proportionate to the speed n of rotation of the output shaft 10'. The control conduit 34 supplies the control medium at this pressure to the control slide 27. When the pressure of the control fluid in the discharge conduit 32 and thus in the control conduit 34 reaches a predetermined value, the control slide 27 is displaced against the force of the spring 29 into the position I so that the conduit 26 communicates with the conduit 28.

The pressurized fluid which is pumped by the variable-output pump 12 permanently acts, through the conduits 26 and 26', on the piston 17 of the power amplifier 16 which has the smaller active area. When the control slide 27 is in the position I, that is, when the conduit 26 communicates with the conduit 28, the pressurized fluid pumped by the variable-output pump 12 also acts on the piston 18 of the power amplifier 16 which has the larger active area. Inasmuch as the pressure of the pressurized fluid which acts on both of the pistons 17 and 18 is the same, but the active area of the piston 18 is larger than that of the piston 17, the force exerted by the piston 18 on the adjusting element 14 exceeds the force exerted on the adjusting element 14 by the piston 17 so that the pump 12, and via the connecting link 15 also the adjusting element 13 of the pump 11, are moved toward high-output positions of the variable-output pumps 11 and 12. In the usual case, the variable-output pumps 12 and 11 are adjusted up to the maximum pumping or output rate thereof. Simultaneously therewith, the extension 15' is adjusted in its position by the link 15 so that the spring 29 is increasingly tensioned.

When the drive 10, such as an internal combustion engine, is subjected to an increased power output demand, which may occur as a result of an increasing pressure head at the outlets of the variable-output pumps 11 and 12 or by coupling additional users to the output shaft 10' of the drive 10, the rotational speed n of the drive 10 and of the output shaft 10' decreases, so that the auxiliary pump 30 is driven at a slower pace and the pressure upstream of the throttle valve 33 also decreases. When the pressure in the discharge conduit 32 drops below a predetermined value, the spring 29 shifts the control slide 27 into its position II, so that the pressure of the pressurized fluid acting on the piston 18 is relieved inasmuch as the conduit 28, under these circumstances, communicates with the relief conduit 35, and at least part of the pressurized medium is discharged through the conduit 28 and the relief conduit 35 into the receptacle 20. In view of the fact that, under these circumstances, the pressurized fluid from the discharge side of the variable-output pump 12 is applied only to the piston 17 of the power amplifier 16, the adjusting element 14 and, simultaneously therewith, also the adjusting element 13, are displaced toward the low-output positions thereof.

Figure 2:
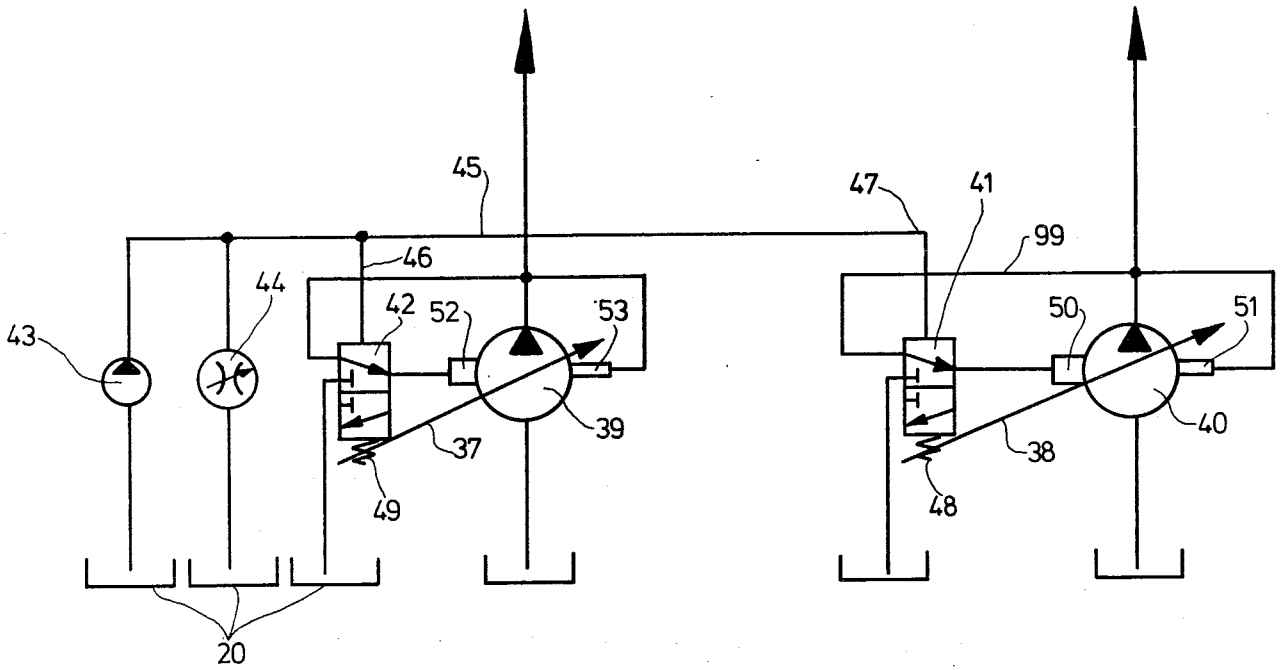
FIG. 2 is a representation similar to FIG. 1 but showing a second embodiment.

As the output rate of the variable-output pumps 11 and 12 decreases, the load to which the drive 10, such as an internal combustion engine, is subjected is reduced commensurately. Simultaneously therewith, the tension of the spring 29 is diminished by retracting the extension 15'. Thus, a new force equilibrium is obtained at the control slide 27 while the drive 10 rotates at a somewhat slower speed. Now, when the speed increases again as a result of reduced load on the drive 10, the control slide 27 is displaced into its position I, and the pumps 11 and 12 are again adjusted toward a higher output rate. The influencing of the tension of the spring 29 introduces a proportionate characteristic into the control arrangement, which substantially contributes to stabilization of the control arrangement in the cooperation thereof with the pumping arrangement The embodiment of FIG. 2 is in many respects similar to that discussed above in connection with FIG. 1. Here again, two variable-output pumps 39 and 40 are present, which are respectively adjusted toward higher and lower outputs by means of adjusting elements 37 and 38. However, in this embodiment the adjusting elements 37 and 38 are not mechanically coupled with one another. Rather, each pump 39 and 40 is equipped with its own control slide, the control slide associated with the pump 40 being designated with the reference numeral 41, and that associated with the pump 39 being designated with the reference numeral 42. The two variable-output pumps 39 and 40, as well as an auxiliary pump 43, are again driven into rotation in a similar manner as that discussed in connection with FIG. 1, but the drive and the output shaft thereof have been omitted for the sake of clarity. The auxiliary pump 43 discharges control fluid into a discharge conduit 45, and a throttle 44 is arranged between the discharge conduit 45 and the receptacle 20. Here again, the throttle valve 44 acts as a flow restrictor which determines the pressure of the control fluid in the conduit 45 for any given speed of rotation of the auxiliary pump 43. Control conduits 46 and 47 communicate the discharge conduit 45 with the slide valves 42 and 41, respectively. Springs 49 and 48 act on the control slides 42 and 41 opposite to the forces exerted on the control slides 42 and 41 by the pressurized control fluid supplied thereto through the conduits 46 and 47. In this embodiment, the adjusting element 38 influences the spring 48 and varies the tension thereof, while the adjusting element 37 similarly varies the tension of the spring 49. The springs 49 and 48 are tensioned and relaxed in a similar manner to that discussed above in connection with FIG. 1.

The movement of the adjusting elements 37 and 38 is accomplished in a manner which, in principle, is the same as that discussed above in connection with FIG. 1. However, the construction of the power amplifier is somewhat different from that discussed above. The two pistons of the power amplifier which act on the adjusting element 38 of the variable-output pump 40 are designated with reference numerals 50 and 51, while those pistons which are associated with the adjusting element 37 of the pump 39 bear the reference numerals 52 and 53. Here again, the pistons 51 and 53 which have smaller active areas are permanently acted upon by the pressure of the fluid from the outlet side of the respective variable-output pumps 40 and 39 while the pistons 50 and 52 which have greater active areas are supplied with the pressurized fluid from the outlet side of the variable-output pumps 40 and 39 through the control slides 41 and 42 in the same manner as discussed previously in connection with FIG. 1. The springs 48 and 49 are relaxed when the output rate of the variable pumps 40 and 39 decreases, and vice versa. The operation of this embodiment of the present invention is similar to that discussed above with reference to FIG. 1, except that the synchronous movement of the adjusting elements 37 and 38 is not obtained by mechanically linking the same, but rather as a result of the simultaneous and commensurate action of the pressurized control fluid on the control slides 42 and 41.

Figure 3:
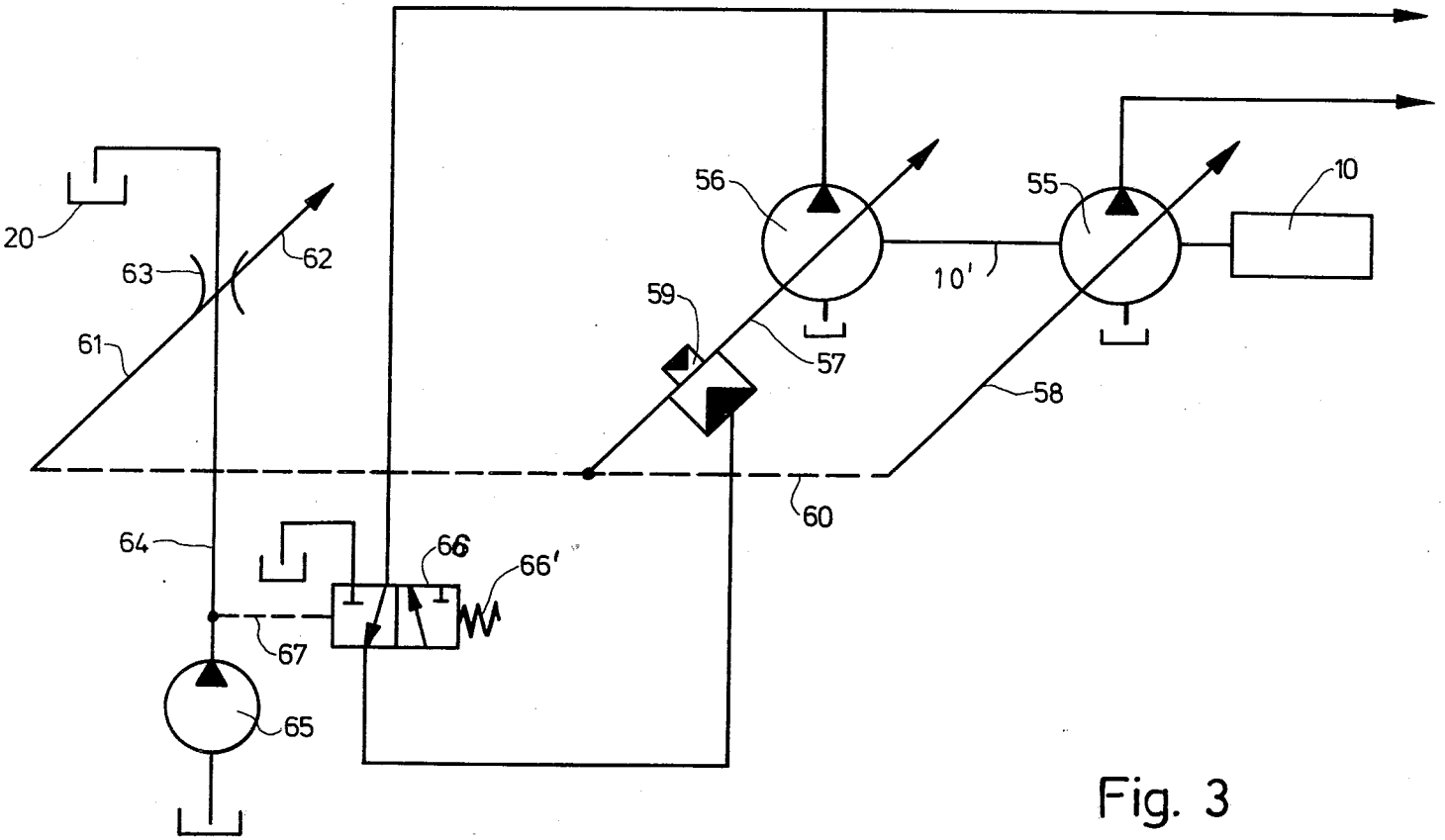
FIG. 3 is a representation similar to FIG. 1 but showing still another embodiment.

The embodiment of the present invention which is illustrated in FIG. 3 is different from the two abovediscussed embodiments in that the tension of the spring which acts on the respective control slide is not adjusted. Rather, the throttle valve which cooperates with the auxiliary pump to establish the pressure of the control fluid has an adjustable flow-through cross-sectional area. In this manner, a proportionally characteristic behavior of the control arrangement is obtained even in this embodiment.

More specifically, the embodiment illustrated in FIG. 3 includes a pair of variable-output pumps 55 and 56 which are driven by a drive 10, such as an internal combustion engine, by means of an output shaft which also drives an auxiliary pump 65. The variable-output pumps 55 and 56 are again equipped with adjusting elements 57 and 58 which are connected to one another by means of a link 60. A power amplifier 59, which exactly corresponds to the power amplifier 16 of FIG. 1, acts on the adjusting element 57 of the variable-output pump 56. The link 60 which mechanically connects the adjusting elements 57 and 58 of the variable-output pumps 56 and 55 is connected to an extension 61 which, in turn, is connected to an adjusting member 62 of a throttle valve 63. The flow-through cross-sectional area of the throttle valve 63 is adjusted by means of the adjusting member 62. In this embodiment, the adjustable flow-through cross-sectional area throttle valve 63 is again arranged in a discharge conduit 64 which communicates the discharge side of the auxiliary pump 65 with the receptacle 20. A control slide 66, which is constructed and operates similarly to the above-discussed control slides, is acted upon by a spring 66' in one direction and by a pressurized control fluid supplied thereto from the discharge conduit 64 by a control conduit 67, in the opposite direction. The control slide 66 again controls the power amplifier 59 in dependence on the pressure of the control fluid in the discharge conduit 64 upstream of the variable flow-through cross-sectional area throttle valve 63. In this manner, the output rates of the pumps 55 and 56, and thus the power demand on the drive 10, such as an internal combustion engine, are controlled in the same way as that discussed above in connection with FIGS. 1 and 2.

In this embodiment, the above-discussed stabilizing proportionality influence is obtained by adjusting the variable flow-through cross-sectional area throttle valve 63. When the variable-output pumps 55 and 56 are adjusted toward lower output rates thereof, the flow-through cross-sectional area of the throttle valve 63 is reduced, and vice versa. This causes a stabilization of the control arrangement.

While the present invention has been discussed in connection with a pumping arrangement including two variable-output pumps, it will be appreciated that it can also be used in other pumping arrangements, that is in arrangements which include only one pump, or more than two variable-output pumps. Also, while the two pumps of the above-discussed embodiments have been illustrated as discharging fluid into separate user circuits, it will be understood that the pumps may discharge fluid into only a single user circuit. However, it is also possible to provide conventional valve arrangements in and between the separate user circuits, so that the fluid discharged by the variable-output pumps can be selectively forwarded into some or all of the user circuits.

Figure 4:
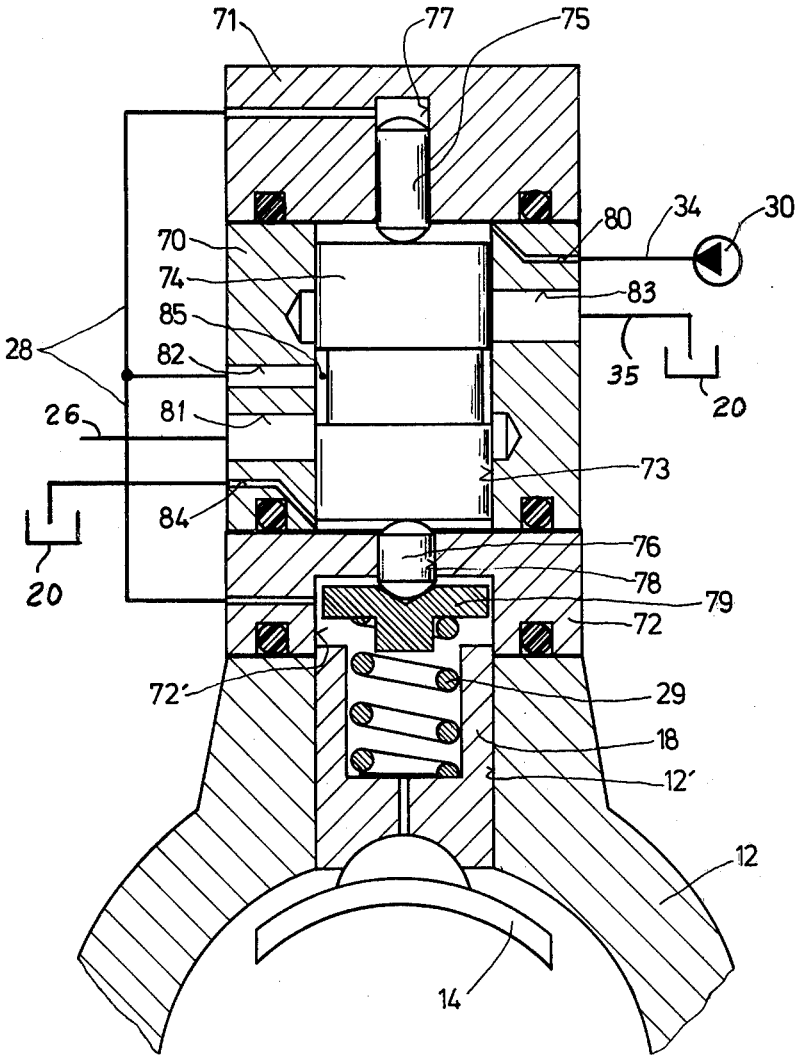
FIG. 4 is a sectional view of a control arrangement according to FIG. 1.

The embodiment of the present invention which is depicted in FIG. 4 discloses a valve construction which can be used, for instance, as the control slide 27 of FIG. 1. The control slide includes a housing portion 70 which is closed, at both axial ends thereof, by the cover portions 71 and 72. The cover portion 72, and thus the entire control slide, is connected to the housing of the pump 12 at that region thereof where the piston 18 cooperating with the adjusting element 14 is mounted for movement. A slide member 74 is sealingly received in a bore 73 provided in the portion 70 of the housing for axial movement therein. The bore 73 is coaxial with a bore 12' of the housing of the pump 12. Plungers 75 and 76 act on the axially spaced end faces of the slide member 74. The plunger 75 is guided in a coaxial bore 77, and the plunger 76 is guided in a coaxial bore 78. A conduit 28 communicates the bore 77 with a coaxial bore 72' of the cover portion 72 so that fluid at the same pressure always acts axially on the plungers 75 and 76 in mutually opposite directions so that, when only the fluid in the conduit 28 acts on the plungers 75 and 76, and thus on the control slide 74, the latter is free to assume any position within the bore 73 inasmuch as the forces exerted on the slide member 74 by the plungers 75 and 76 cancel each other out regardless of the pressure which acts on the plungers 75 and 76.

A spring 29 is partially received in the bore 72' and acts, via a disc-shaped member 79 freely received in the bore 72', and via the plunger 76, on the slide member 74. The other end of the spring 29 abuts against the piston 18. The control conduit 34 from the auxiliary pump 30 communicates with a bore 80 which, in turn, communicates with the bore 73 upwardly, as seen in FIG. 4, of the slide member 74. Thus, the pressure of the control fluid in the conduit 34 acts on the upper end face of the slide member 74 against the force exerted upon the lower end face of the slide member 74 by the spring 29.

Three transverse bores 81, 82 and 83 communicate with the bore 73. The conduit 26 from the discharge side of the pump 12 is connected to the transverse bore 81, the relief conduit 35 leading to the receptacle 20 communicates with the bore 83, and the transverse bore 82 communicates with the conduit 28. A further transverse bore 84 communicates the space between the lowwer end face of the slide member 74 and the cover portion 72 with the receptacle 20, via a branch of the relief conduit 35, so that pressure cannot build up in this space. The slide member 74 is formed with an annular circumferential recess 85 through which, depending on the position of the slide member 74, communication is established between the transverse bore 81 and the transverse bore 82, or between the transverse bore 82 and the transverse bore 83.

The valve arrangement operates in the same way as discussed above in connection with FIG. 1. Basically, so long as the pressure of the control fluid in the control conduit 34 is low, the spring 29 displaces the slide member 74 into its uppermost position in which communication is established between the conduits 28 and 35, via the transverse bores 82 and 83 and the annular recess 85 of the control slide member 74. Thus, the pressure acting on the piston 18 is lower than that acting on the non-illustrated piston 17, so that the adjusting element 14 adjusts the pump 12 to higher output rates. As the speed of rotation of the pump 12, and thus of the auxiliary pump 30, increases, the pressure in the control conduit 34 also increases until the force of the control fluid which acts on the upper end face of the slide member 74 exceeds the force of the spring 29, whereby the slide member 74 is displaced downwardly into the illustrated position thereof. At this time, the slide member 74 interrupts communication of the transverse bore 83, and thus of the relief conduit 35, with the bore 73 and, simultaneously therewith, communication is established between the conduit 26 and the transverse bore 81, and the annular recess 85. In this manner, the pressurized fluid from the output side of the variable-output pump 12 is supplied into the recess 85, and the fluid flows from the annular recess 85, through the transverse bore 82, into the conduit 28. Thus, the pressurized medium from the output side of the variable-output pump 12 acts on the piston 18 so that the latter is displaced downwardly and adjusts the actuating element 14 toward higher outputs of the variable-output pump 12. Inasmuch as the spring 29 abuts against the piston 18, the tension of the spring 29 changes as the piston 18 moves upwardly or downwardly. The upper and lower positions of the slide member 74 correspond to the positions II and I of the control slide 27 of FIG. 1.

Figure 5:
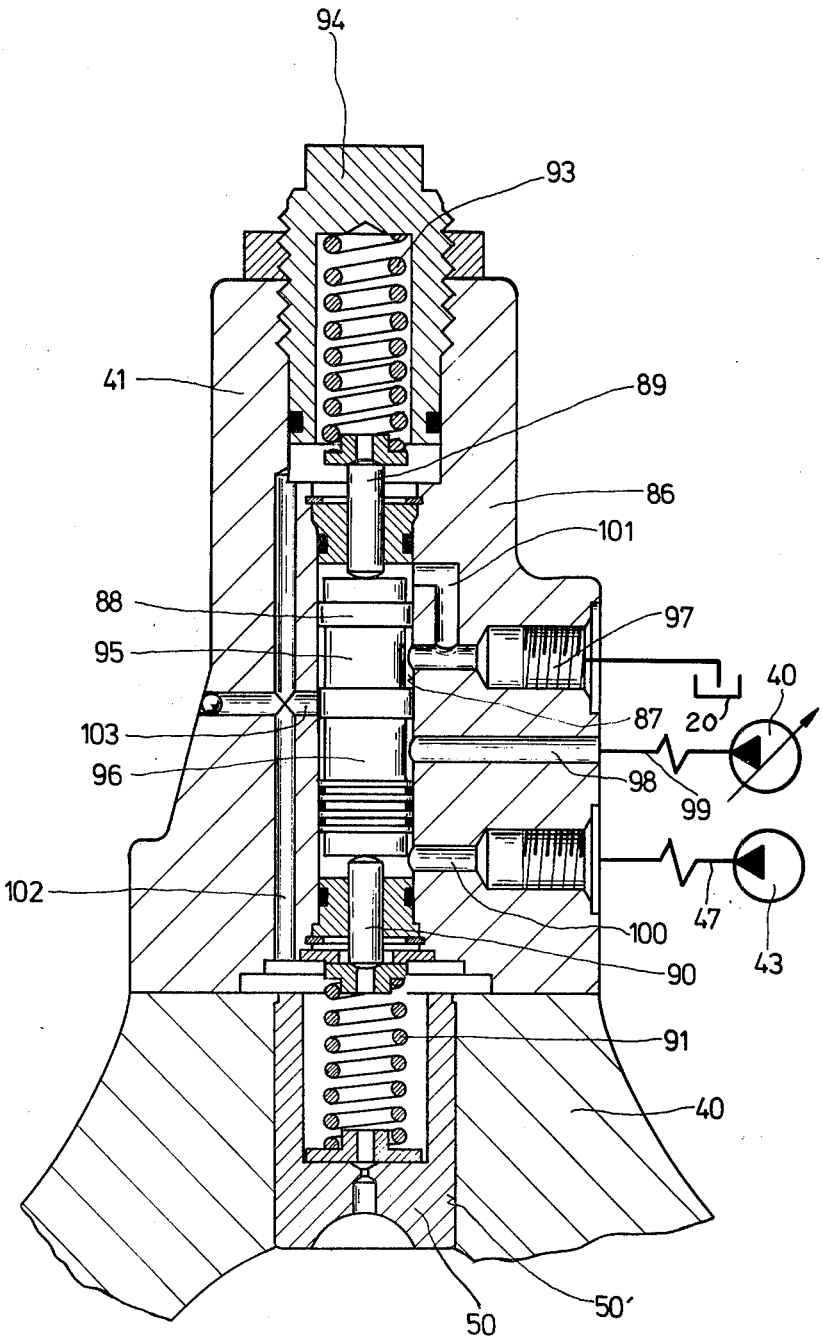
FIG. 5 is a sectional view of a control arrangement according to FIG. 2.

FIG. 5 shows a longitudinal sectional view of a valve which can be used as the control slide 41 or 42 of FIG. 2. In this embodiment, the output rate of the respective pump 40 is increased when elevated pressure acts on the piston 50.

The valve arrangement of FIG. 5 includes a housing 86 which is provided with a longitudinal bore 87, and a slide member 88 is sealingly guided in the longitudinal bore 87 for movement between an upper position and a lower position as seen in the drawing. A pair of plungers 89 and 90 acts at the axially spaced end faces of the slide member 88, and a spring 91 acts on the plunger 90 and rests against the larger active area piston 50 of the power amplifier of the pump 40. The plunger 89 is acted upon by a spring 93, the upper end of which rests against a closing screw 94 threaded into the housing 86. The springs 91 and 93, in cooperation with one another, accomplish the same result as the spring 48 of the diagrammatic representation of FIG. 2.

The slide member 88 is formed with two annular recesses 95 and 96, of which the annular recess 95 cooperates with a transverse bore 97 which, in turn, communicates with the receptacle 20. The annular recess 96 cooperates with a transverse bore 98 which, in turn, communicates with the outlet side of the variable-output pump 40, via a conduit 99. A third transverse bore 100 has a connection, through the conduit 47, with the auxiliary pump 43. An end space of the longitudinal bore 87 which is adjacent the plunger 89 is in communication, via a bore 101, with the transverse bore 97. The housing of the variable-output pump 40 has a coaxial bore 50′ which is connected, through a longitudinal bore 102, with the space which accommodates the spring 93. This space, in turn, communicates with the longitudinal bore 87 via a transverse bore 103.

Even though the function of this arrangement has been discussed above in connection with FIG. 2, it will be now briefly recapitulated. So long as the pessure in the control conduit 47 of the auxiliary pump 43 is relatively low, this pressure acting on the control slide 88 from below through the transverse bore 100, the spring 93 urges the control slide member 88 toward its lower position. In this position, the longitudinal bore 102 communicates with the annular recess 95 so that the piston 50 is subjected to the pressure prevailing in the receptacle 20. When the pressure in the control conduit 47 rises, the slide member 88 is displaced upwardly, so that communication of the longitudinal bore 102 with the annular space 95 is interrupted, and communication of the longitudinal bore 102 with the annular space 96 established. Thus, the pressurized fluid from the outlet side of the variable-output pump 40 is forwarded, through the conduit 99, the transverse bore 98, the annular recess 96, and the longitudinal bore 102, into the coaxial longitudinal bore 50′ of the housing of the variable-output pump 40, so that the piston 50 moves downwardly and thus relaxes the spring 91. In this manner, the tension of the two cooperating springs 93 and 91 is influenced in the manner which has been discussed above in connection with FIG. 2.

It is also contemplated by the present invention that, instead of adjusting the tension of the springs 29, 48 and 49, or the flow-through cross-sectional area of the throttle valve 53, the auxiliary pump 30, and particularly the discharge rate or the speed of rotation thereof, can be so influenced by the adjusting element of the variable-output pump that the above-discussed proportionately characteristic behavior of the control arrangement is obtained. p It will be understood that each of the elements described above, or two or more together, may also find a useful application in other types of constructions differing from the types described above.

While the invention has been illustrated and described as embodied in a control arrangement for a pumping arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an arrangement for pumping fluids, a combination comprising pump means for pumping a fluid at a variable output rate, including at least one variable-output pump having an adjusting element movable between a high-output position and a low-output position through a plurality of intermediate positions; drive means for driving said pump means at different speeds; first generating means for generating a first signal proportionate only to the instantaneous speed of said drive means, including an auxiliary pump driven by said drive means and operative for discharging control fluid at a discharge rate proportionate only to the speed of said drive means, a discharge conduit communicating with said auxiliary pump, and a throttle valve in said discharge conduit; second generating means for generating a second signal indicative only of the instantaneous output rate of said pump, including said adjusting element; and adjusting means for adjusting the output rate of said pump means in dependence on said first and second signals, including moving means for moving said actuating element between said positions, including a cylinder-and-piston arrangement acting on said adjusting element, and conduit means for supplying pressurized fluid to said arrangement; control means for controlling said moving means and displaceable between two positions in which said pump means is adjusted toward higher and lower output rates, respectively, including a control slide interposed in said conduit means and operative for controlling the supply of the pressurized fluid to said moving means and a valve housing bounding a chamber with said control slide; displacing means for displacing said control means between said positions thereof, said displacing means including first biasing means urging said control means toward one of said positions with a first force proportionate to said first signal, including a connecting conduit communicating said discharge conduit with said chamber so that said control fluid discharged by said auxiliary pump acts on said control slide, and second biasing means urging said control means toward the other position with a second force, and including a spring acting on said control slide against the action of said control fluid in said chamber, and varying means for varying one of said forces in dependence only on said second signal, including a motion-transmitting element connected to said adjusting element for movement therewith and operative for varying the tension of said spring to thereby vary said second force.

2. In an arrangement for pumping fluids, a combination comprising pump means for pumping a fluid at a variable output rate, including at least one variable-output pump having an adjusting element movable between a high-output position and a low-output position through a plurality of intermediate positions; drive means for driving said pump means at different speeds; first generating means for generating a first signal proportionate only to the instantaneous speed of said drive means, including an auxiliary pump driven by said drive means and operative for discharging control fluid at a discharge rate proportionate only to the speed of said drive means, a discharge conduit communicating with said auxiliary pump, and a throttle valve in said discharge conduit; second generating means for generating a second signal indicative only of the instantaneous output rate of said pump means; and adjusting means for adjusting the output rate of said pump means in dependence on said first and second signals, including moving means for moving said actuating element between said positions, including a cylinder-and-piston arrangement acting on said adjusting element, and conduit means for supplying pressurized fluid to said arrangement, control means for controlling said moving means and displaceable between two positions in which said pump means is adjusted toward higher and lower output rates, respectively, including a control slide interposed in said conduit means and operative for controlling the supply of the pressurized fluid to said moving means, and a valve housing bounding a chamber with said control slide, displacing means for displacing said control means between said positions thereof, said displacing means including first biasing means urging said control means toward one of said positions with a first force proportionate to said first signal, including a connecting conduit communicating said discharge conduit with said chamber so that said control fluid discharged by said auxiliary pump acts on said control slide, and second biasing means urging said control means toward the other position with a second force, including a spring acting on said control slide against the action of said control fluid in said chamber, and varying means for so varying said one force in dependence only on said second signal that said spring is relaxed in response to a decrease in the output rate of said variable-output pump.

3. A combination as defined in claim 2, wherein said pump means includes at least one additional variable-output pump similar to said variable-output pump; and further comprising connecting means for so connecting said variable-output pumps as to simultaneously vary the output rates thereof.

4. A combination as defined in claim 3, wherein said connecting means includes a linking arrangement for mechanically connecting the adjusting elements of said variable-output pumps for corresponding movements between said high-output and low-output positions thereof.

5. A combination as defined in claim 3; further comprising additional second generating means and additional adjusting means similar to said second generating means and said adjusting means, respectively, and associated with said additional variable-output pump; and wherein said connecting means includes said connecting conduit and an additional connecting conduit which are supplied with the control fluid from said discharge conduit at the same pressure, said additional conduit communicating with the chamber of the control means associated with said additional variable-output pump.

6. A combination as defined in claim 3, wherein said variable-output pumps pump the fluid into separate user circuits.

7. A combination as defined in claim 6, and further comprising means for selectively communicating said variable-output pumps with said user circuits.

8. In an arrangement for pumping fluids, a combination comprising pump means for pumping a fluid at a variable output rate, including at least one variable-output pump having an adjusting element movable between a high-output position and a low-output position through a plurality of intermediate positions; drive means for driving said pump means at different speeds; first generating means for generating a first signal proportionate only to the instantaneous speed of said drive means; second generating means for generating a second signal indicative only of the instantaneous output rate of said pump means; and adjusting means for adjusting the output rate of said pump means in dependence on said first and second signals, including moving means for moving said actuating element between said positions, including a cylinder-and-piston arrangement acting on said adjusting element and including a first piston of a smaller active area and a second piston of a larger active area, control means displaceable between two positions in which said pump means is adjusted toward higher and lower output rates, respectively, including a control slide interposed in said second conduit and operative for communicating the supply of the pressurized fluid with said moving means only when said control means is in said one position thereof, displacing means for displacing said control means between said positions thereof, said displacing means including first biasing means urging said control means toward one of said positions with a first force proportionate to said first signal, and second biasing means urging said control means toward the other position with a second force, and varying means for varying one of said forces in dependence only on said second signal.

9. In an arrangement for pumping fluids, a combination comprising pump means including at least one variable output pump for pumping a fluid and having an adjusting element for adjusting the output rate of said pump; drive means for driving said pump means at different speeds; first generating means for generating a first signal proportionate only to the instantaneous speed of said drive means; second generating means for generating a second signal indicative only of the instantaneous output rate of said pump means, including said adjusting element; and adjusting means for adjusting the output rate of said pump means in dependence on said first and second signals, including control means displaceable between two positions in which said pump means is adjusted toward higher and lower output rates, respectively, displacing means for displacing said control means between said positions thereof, including biasing means urging said control means toward one of said positions with a first force proportionate to said first signal, and a spring urging said control means toward the other position with a second force, said adjusting means further including varying means for varying one of said forces in dependence only on said second signal, including a motion-transmitting element connected to said adjusting element for movement therewith and operative for varying the tension of said spring to thereby vary said second force.

10. In an arrangement for pumping fluids, a combination comprising pump means for pumping a fluid at a variable output rate including at least one variable-output pump which has an adjusting element that is movable between a low-output and a high-output position through a plurality of intermediate positions to adjust the output rate of said pump in dependence on the instantaneous position thereof; drive means for driving said pump means at different speeds; first generating means for generating a first signal proportionate only to the instantaneous speed of said drive means; second generating means for generating a second signal indicative only of the instantaneous position of said adjusting element; and moving means for moving said adjusting element in dependence on said first and second signals, including control means displaceable between a first and a second position in which said adjusting element is moved toward said high-output position and said low-output position, respectively, displacing means for displacing said control means between said first and second positions thereof and including urging means which urges said control means toward said first position with a first force proportionate to said first signal and a spring which urges said control means toward said second position with a second force, and varying means for so varying one of said forces in dependence only on said second signal that, for the same speed of said drive means, the ratio of said second to said first force increases proportionately to the extent of movement of said adjusting element toward said high-output position thereof.

11. A combination as defined in claim 10, wherein said moving means includes a cylinder-and-piston unit acting on said adjusting element, and conduit means for supplying pressurized fluid to said unit; and wherein said control means includes a control slide interposed in said conduit means and operative for controlling the supply of the pressurized fluid to said unit.

12. A combination as defined in claim 11, wherein said control means further includes a valve housing bounding a chamber with said control slide; wherein said first generating means includes an auxiliary pump driven by said drive means and operative for discharging control fluid at a discharge rate proportionate only to the speed of said drive means, a discharge conduit communicating with said auxiliary pump, and a throttle valve in said discharge conduit; and wherein said first biasing means includes a connecting conduit communicating said discharge conduit with said chamber so that said control fluid discharged by said auxiliary pump acts on said control slide.

13. A combination as defined in claim 12, wherein said throttle valve has a constant flow-through cross-sectional area for a given load of said drive means.

14. A combination as defined in claim 12, wherein said second generating means includes said adjusting element; wherein said throttle valve has an adjustable flow-through cross-sectional area; and wherein said varying means includes a motion-transmitting element connected to said adjusting element for movement therewith and operative for varying said flow-through cross-sectional area of said throttle valve to thereby vary said first force.

15. A combination as defined in claim 14, wherein said varying means so varies said flow-through cross-sectional area that the latter decreases in response to a decrease in the output rate of said variable-output pump, and vice versa.

16. A method of controlling an arrangement for pumping fluids which includes at least one variable-output pump having an adjusting element that is movable between a low-output position and a high-output position through a plurality of intermediate positions to adjust the output rate of the pump in dependence on the instantaneous position thereof, a drive for driving the pump at different speeds, and a control slide displaceable between a first and a second position in which the adjusting element is moved toward the high-output position and the low-output position, respectively, said method comprising the steps of generating a first signal proportionate only to the instantaneous speed of the drive; generating a second signal indicative only of the instantaneous position of the adjusting element; and moving the adjusting element of the pump in dependence on said first and second signals, including urging the control slide toward the first position thereof with a first force proportionate to the first signal, biasing the control slide toward the second position with a second force, and so varying one of said forces in dependence only on said second signal that, for the same speed of the drive, the ratio of said second to said first force increases proportionately to the extent of movement of the adjusting element toward the high-output position thereof.

17. In an arrangement for pumping fluids, a combination comprising pump means for pumping a fluid at a variable output rate, including at least one variable-output pump having an adjusting element movable between a high-output position and a low-output position through a plurality of intermediate positions; drive means for driving said pump means at different speeds; first generating means for generating a first signal proportionate to the instantaneous speed of said drive means; second generating means for generating a second signal indicative of the instantaneous output rate of said pump means; and adjusting means for adjusting the output rate of said pump means in dependence on said first and second signals, including moving means for moving said actuating element between said positions, including a cylinder-and-piston arrangement acting on said adjusting element and including a first piston of a smaller active area and a second piston of a larger active area, and conduit means for supplying pressurized fluid to said arrangement, including a first conduit permanently communicating a discharge side of said variable-output pump with said first piston, and a second conduit communicating the discharge side with said second piston, control means displaceable between two positions in which said pump means is adjusted toward higher and lower output rates, respectively, including a valve housing having an elongated bore and being formed with three transverse ports communicating with said elongated bore, one of said ports communicating with a portion of said second conduit which communicates with said discharge side, another port communicating with a source of fluid at atmospheric pressure, and still another port communicating with another portion of said second conduit which communicates with said second piston, said control means further including a control slide interposed in said second conduit and operative for communicating the supply of the pressurized fluid with said moving means only when said control means is in said one position thereof, said control slide being sealingly and coaxially mounted in said bore for displacement between said positions and having two axially spaced end faces one of which bounds a chamber and is acted upon by said pressurized fluid, displacing means for displacing said control means between said positions thereof, said displacing means including first biasing means urging said control means toward one of said positions with a first force proportionate to said first signal, and second biasing means urging said control means toward the other position with a second force and including a plunger mounted in said housing coaxially with said bore for displacement, and a spring acting on said plunger and urging the same into contact with the other end face of said control slide, and varying means for varying one of said forces in dependence on said second signal.

18. A combination as defined in claim 17, wherein said spring is accommodated in said second piston.

19. In an arrangement for pumping fluids, a combination comprising pump means for pumping a fluid at a variable output rate, including at least one variable-output pump having an adjusting element movable between a high-output position and a low-output position through a plurality of intermediate positions; drive means for driving said pump means at different speeds; first generating means for generating a first signal proportionate to the instantaneous speed of said drive means, including an auxiliary pump driven by said drive means and operative for discharging control fluid at a discharge rate proportionate to the speed of said drive means, a discharge conduit communicating with said auxiliary pump, and a throttle valve in said discharge conduit; second generating means for generating a second signal indicative of the instantaneous output rate of said pump means; and adjusting means for adjusting the output rate of said pump means in dependence on said first and second signals, including moving means for moving said actuating element between said positions, including a cylinder-and-piston arrangement acting on said adjusting element, and conduit means for supplying pressurized fluid to said arrangement, control means for controlling said moving means and displaceable between two positions in which said pump means is adjusted toward higher and lower output rates, respectively, including a control slide interposed in said conduit means and operative for controlling the supply of the pressurized fluid to said moving means, and a valve housing bounding a chamber with said control slide, displacing means for displacing said control means between said positions thereof, said displacing means including first biasing means urging said control means toward one of said positions with a first force proportionate to said first signal, including a connecting conduit communicating said discharge conduit with said chamber so that said control fluid discharged by said auxiliary pump acts on said control slide, and second biasing means urging said control means toward the other position with a second force, including a spring acting on said control slide against the action of said control fluid in said chamber, and varying means for so varying said one force in dependence on said second signal that said spring is relaxed in response to a decrease in the output rate of said variable-output pump, including an additional spring acting on said control slide against the action of said spring with a third force, said third force increasing in response to a decrease in the output rate of said variable-output pump, and vice versa.

20. In combination with a variable-throughput pump; an arrangement for controlling the operation of the pump, comprising drive means coupled to the pump and driving the pump;

hydraulically controlled adjusting means for adjusting the volumetric throughput of the pump and having minimum, maximum and intermediate volumetric-throughput settings;

control valve means connected to and controlling the adjusting means, the control valve means comprising a valve member movable between a throughput-decrease setting to which the adjusting means responds by decreasing the volumetric throughput of the pump and a througput-increase setting to which the adjusting means responds by increasing the volumetric throughput of the pump, the control valve means including biasing means urging the valve member to the throughput-decrease setting;

rpm-sensing means sensing the rpm of the drive means and urging the valve member of the control valve means to the throughput-increase setting thereof with a force dependent upon the rpm of the drive means, the biasing force applied to the valve member by biasing means being overcome by the urging force applied to the valve member by the rpm-sensing means when the rpm of the drive means drops below a steady-state value, as a result of which the valve member moves toward the throughput-decrease setting so as to reduce the load driven by the drive means and thereby permit the rpm of the drive means to increase back towards the steady-state value, the urging force applied to the valve member by the rpm-sensing means being overcome by the biasing force applied by the biasing means when the rpm of the drive means rises to above the steady-state value, as a result of which the valve member moves towards the throughput-increase setting so as to increase the load driven by the drive means and thereby cause the rpm of the drive means to decrease back towards the steady-state value, and transient-response varying means sensing the volumetric throughput of the pump and in dependence thereon automatically varying one of the two opposing forces applied to the valve member in a sense decreasing the steady-state value when the throughput of the pump decreases and increasing the steady-state value when the throughput of the pump increases, whereby if the drive means becomes too heavily loaded and its rpm therefore drops and the valve member responds by assuming the throughput-decrease setting, then, as the rpm of the drive means thereupon increases, the movement of the valve member back to the throughput-increase setting occurs at a lowered steady-state rpm value, so as to prevent an excessive-duration throughput decrease lasting longer than actually needed for the drive-means rpm to return to a steady-state value.

21. The arrangement defined in claim 20, the transient-response varying means comprising means decreasing the biasing force applied to the valve member by the biasing means when the volumetric throughput of the pump decreases and increasing the biasing force applied to the valve member by the biasing means when the volumetric throughput of the pump increases.

22. The arrangement defined in claim 21, the rpm-sensing means comprising an auxiliary pump driven by the drive means and a flow restrictor through which the auxiliary pump discharges, the hydraulic pressure just upstream of the flow restrictor being a quadratic function of the rpm of the drive means, and furthermore including a control-pressure line extending from upstream of the flow restrictor to the valve member and urging the valve member towards the throughput-increase setting.

23. The arrangement defined in claim 22, the means decreasing and increasing the biasing force of the biasing means comprising a mechanical linkage coupled between the biasing means and the hydraulically controlled adjusting means.

24. The arrangement defined in claim 20, the control valve means being a two-setting valve.

* * * * *